US009228711B2

(12) United States Patent
Park

(10) Patent No.: US 9,228,711 B2
(45) Date of Patent: Jan. 5, 2016

(54) LAMP FOR VEHICLE

(71) Applicant: SL Corporation, Daegu (KR)

(72) Inventor: Ki Beom Park, Gyeongsangbuk-Do (KR)

(73) Assignee: SL Corporation, Daegu (KR)

( * ) Notice: Subject to any disclaimer, the term of this patent is extended or adjusted under 35 U.S.C. 154(b) by 83 days.

(21) Appl. No.: 14/015,182

(22) Filed: Aug. 30, 2013

(65) Prior Publication Data

US 2014/0063833 A1 Mar. 6, 2014

(30) Foreign Application Priority Data

Sep. 6, 2012 (KR) ..... 10-2012-0098848

(51) Int. Cl.
*F21S 8/10* (2006.01)

(52) U.S. Cl.
CPC ..... *F21S 48/14* (2013.01); *F21S 48/1154* (2013.01); *F21S 48/145* (2013.01)

(58) Field of Classification Search
CPC ..... F21S 48/1154; F21S 48/14; F21S 48/145
USPC ..... 362/539
See application file for complete search history.

(56) References Cited

U.S. PATENT DOCUMENTS

| | | | | |
|---|---|---|---|---|
| 1,435,014 | A * | 11/1922 | Lewis et al. | 362/243 |
| 5,021,930 | A * | 6/1991 | Yamada | 362/539 |
| 7,036,969 | B2 * | 5/2006 | Foust et al. | 362/539 |
| 7,134,771 | B2 | 11/2006 | Stout et al. | |
| 7,625,109 | B2 * | 12/2009 | Tsukamoto | 362/538 |
| 2005/0018440 | A1 | 1/2005 | Koike et al. | |
| 2005/0018443 | A1 | 1/2005 | Tsukamoto | |
| 2005/0041434 | A1 | 2/2005 | Yatsuda et al. | |
| 2006/0087862 | A1 | 4/2006 | Ishida | |
| 2007/0002577 | A1 | 1/2007 | Tsukamoto | |

FOREIGN PATENT DOCUMENTS

| | | | |
|---|---|---|---|
| DE | 3718642 | C1 | 10/1988 |
| EP | 0293959 | A2 | 12/1988 |
| EP | 1308669 | A1 | 5/2003 |
| EP | 1584862 | A1 | 10/2005 |
| EP | 2 028 414 | A1 | 2/2009 |
| EP | 2420728 | A1 | 2/2012 |

(Continued)

OTHER PUBLICATIONS

European Search Report dated Mar. 31, 2014 in connection with European Application No. 13182989.7.

*Primary Examiner* — Stephen F Husar
(74) *Attorney, Agent, or Firm* — Mintz Levin Cohn Ferris Glovsky and Popeo, P.C.; Kongsik Kim; Colleen H. Witherell

(57) ABSTRACT

A lamp for a vehicle, and more particularly, a lamp for a vehicle capable of forming a suitable light irradiation pattern and improving chromatic aberration so as to prevent light blindness is provided. In particular, the lamp includes a light source unit including at least one light source, a shield unit configured to block a part of the light irradiated from the light source unit by one or more light blocking portions formed to have an outer circumferential end (curved end) toward an optical axis of the light source unit, and a lens unit configured to irradiate the light passing through the shield unit to the outside.

16 Claims, 14 Drawing Sheets

(56) References Cited

FOREIGN PATENT DOCUMENTS

| | | | |
|---|---|---|---|
| JP | 2005-235520 | A | 9/2005 |
| JP | 2007012478 | A | 1/2007 |
| KR | 10-2004-0040390 | A | 5/2004 |

* cited by examiner

LAMP FOR VEHICLE

CROSS-REFERENCE TO RELATED APPLICATION

This application claims priority from Korean Patent Application No. 10-2012-0098848 filed on Sep. 6, 2012 in the Korean Intellectual Property Office, and all the benefits accruing therefrom under 35 U.S.C. 119, the contents of which in its entirety are herein incorporated by reference.

BACKGROUND

The present invention relates to a lamp for a vehicle, and more particularly, to a lamp for a vehicle capable of forming a suitable light irradiation pattern and improving chromatic aberration so as to prevent light blindness.

In general, a vehicle is provided with various lamps for illuminating various areas around and within the vehicle. These lamps allow a driver to easily identify objects within the periphery of the vehicle when the vehicle is driven at night, and provide a signal function that informs other drivers or persons around the vehicle of a driving state of the vehicle.

For example, a head lamp, a fog lamp, and the like are mainly provided for the purpose of providing light, and a turn signal lamp, a tail lamp, a brake lamp, a side marker, and the like are provided for the purpose of signaling. In addition, installation references and standards for the lamps for a vehicle are legislated by regulations so that the lamp for a vehicle may sufficiently perform each of the functions.

Recently, there has been a trend toward using light emitting diodes as a light source within vehicle lamps in order to simplify the complicated configurations of the lamps or process steps, and to overcome problems in terms of extending the lifespan of the lamp using the characteristics of the light emitting diode or the amount of space that the lamp takes up by using a small sized light emitting diode.

Lamp in a vehicle are typically provided with a shield in order to block a part of the light irradiated from a light source toward the front side of the light source so as to prevent light blindness, while still forming a light irradiation pattern capable of securing a sufficient visual field.

In addition, vehicular lamps often use an aspherical lens that has various curvatures in accordance with an irradiation range of the light. As such, a spectrum phenomenon may occur in accordance with a material or a curvature of the aspherical lens. For example, the spectrum phenomenon is relatively increased when a curvature of the aspherical lens is large or the aspherical lens is made of a plastic material.

Therefore, a method is required which forms a light irradiation pattern suitable for vehicle vehicular lamp that prevents a spectrum phenomenon form occurring due to the aspherical lens.

SUMMARY

The present invention has been made in an effort to provide a lamp for a vehicle in which a shield, which blocks a part of light irradiated from a light source, is formed to have a curved end (i.e., convex shape) toward an optical axis such that the light irradiated toward an upper side based on a cut off line is blocked so as to prevent light blindness and efficiently prevent a spectrum phenomenon.

An exemplary embodiment of the present invention provides a lamp for a vehicle including: a light source unit having at least one light source; a shield unit configured to block a part of the light irradiated from the light source unit by one or more light blocking portions formed to have an outer circumferential end (i.e., curved end) toward an optical axis of the light source unit; and a lens unit configured to irradiate the light passing through the shield unit to the outside.

According to the head lamp for a vehicle of the present invention, as described above, there are one or more effects as follows.

First, a shield is formed at a front side of the light source so as to have a convex shape toward an optical axis so that the light irradiated to an upper side based on a cut off line is removed so as to prevent light blindness.

Second, since the shield is formed at the front side of the light source so as to have the convex shape toward the optical axis, the spectrum phenomenon, which occurs in accordance with a curvature or a material of the aspheric al lens, may be removed, thereby improving chromatic aberration.

The effects of the present invention are not limited to the aforementioned effects, and other effects, which are not mentioned above, will be apparently understood by the person skilled in the art from the recitations of the claims.

BRIEF DESCRIPTION OF THE DRAWINGS

The above and other features and advantages of the present invention will become more apparent by describing in detail embodiments thereof with reference to the attached drawings in which.

DETAILED DESCRIPTION OF THE EMBODIMENTS

Figure 1:
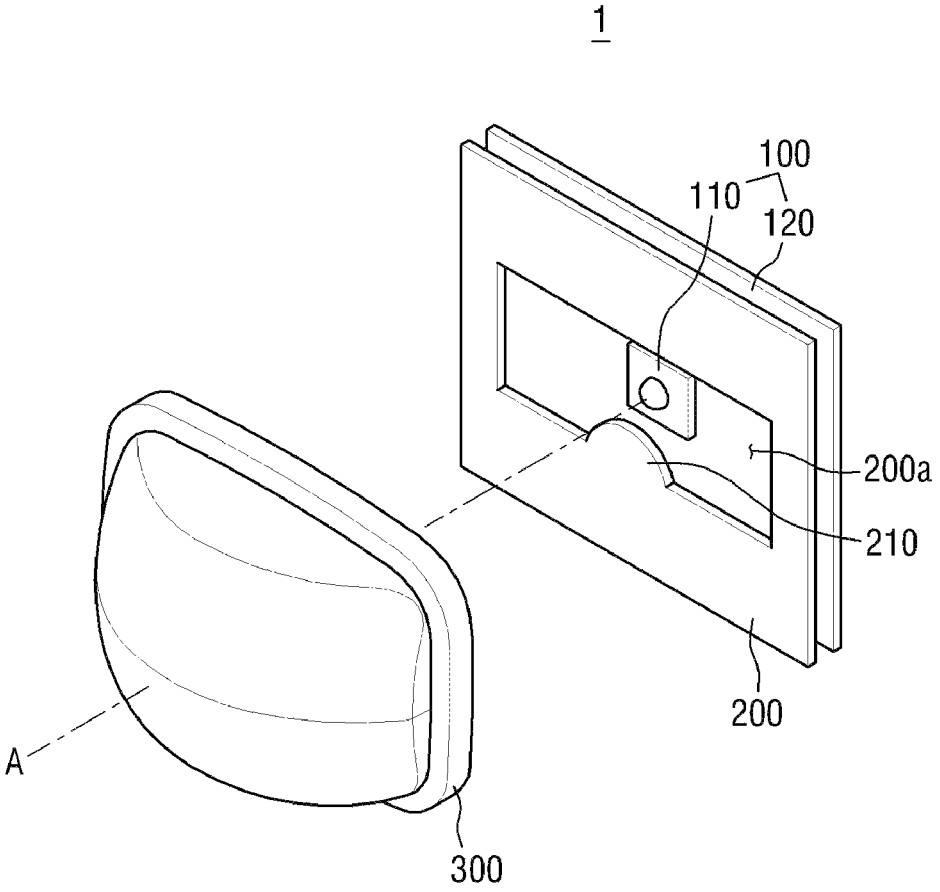
FIG. 1 is a perspective view illustrating a lamp for a vehicle according to an exemplary embodiment of the present invention.

Advantages and features of the present invention and methods of accomplishing the same may be understood more readily by reference to the following detailed description of preferred embodiments and the accompanying drawings. The present invention may, however, be embodied in many different forms and should not be construed as being limited to the embodiments set forth herein. Rather, these embodiments are provided so that this disclosure will be thorough and complete and will fully convey the concept of the invention to those skilled in the art, and the present invention will only be defined by the appended claims. Like reference numerals refer to like elements throughout the specification.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on", "directly connected to" or "directly coupled to" another element or layer, there are no intervening elements or layers present. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, these embodiments should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and this specification and will not be interpreted in an idealized or overly formal sense unless expressly so defined herein.

Hereinafter, the present invention will be described with reference to the drawings for explaining a lamp for a vehicle according to embodiments of the present invention.

Figure 2:
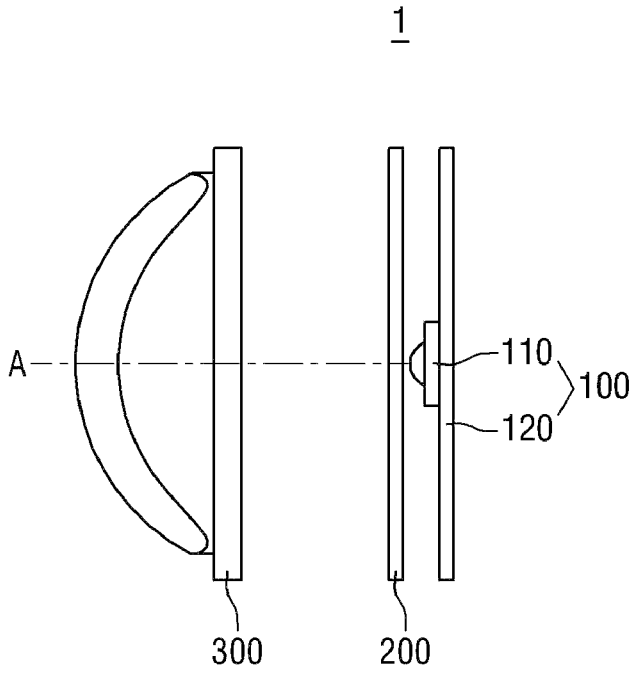
FIG. 2 is a plan view illustrating the lamp for a vehicle according to the exemplary embodiment of the present invention.
Figure 3:
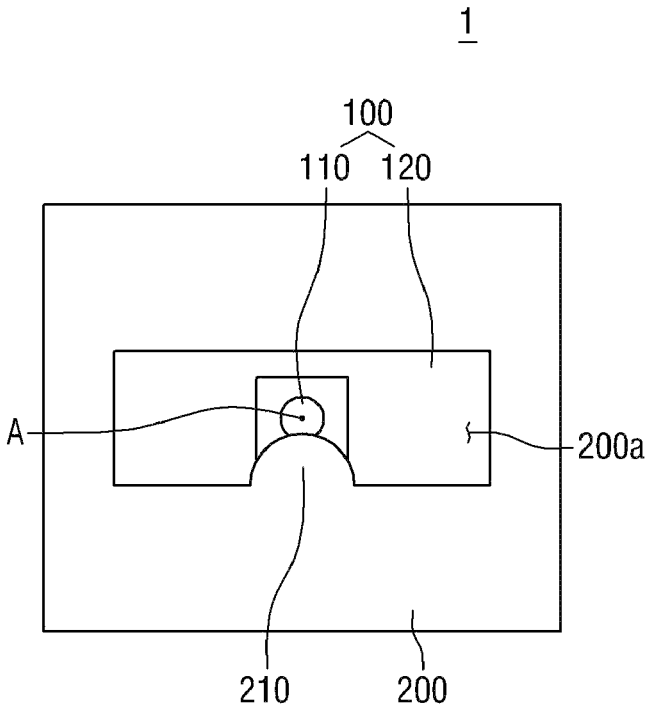
FIG. 3 is a front side view illustrating the lamp for a vehicle according to the exemplary embodiment of the present invention.

FIG. 1 is a perspective view illustrating a lamp for a vehicle according to an exemplary embodiment of the present invention, FIG. 2 is a plan view illustrating the lamp for a vehicle according to the exemplary embodiment of the present invention, and FIG. 3 is a front side view illustrating the lamp for a vehicle according to the exemplary embodiment of the present invention.

As illustrated, a lamp 1 for a vehicle according to the exemplary embodiment of the present invention may include a light source unit 100, a shield unit 200, and a lens unit 300.

In the exemplary embodiment of the present invention, the lamp 1 for a vehicle will be described as an example of a fog lamp installed in the vicinity of a front bumper of the vehicle, but this example is merely one example for better understanding of the present invention, and the lamp for vehicle is not limited thereto and may be various types of lamps such as a head lamp, a tail lamp, a brake lamp, a turn signal lamp, and a back up lamp, which are installed in the vehicle. In addition, in the exemplary embodiment of the present invention, as an example of the lamp 1 for a vehicle, a direct type of lamp will be described which is not provided with a reflector that collects light irradiated from the light source unit 100 to a focal point positioned at a front side of the light source unit 100, but this example is merely for better understanding of the present invention, and the reflector may be provided in the lamp 1 for a vehicle in some cases.

The light source unit 100 may also include a light source 110, and a substrate 120 on which the light source 110 is installed.

In the embodiment of the present invention, as an example in which a light emitting diode is used as the light source 110 will be described, and because luminous efficiency of the light emitting diode is rapidly decreased in accordance with an increase in temperature, a cooling apparatus such as a heat sink or a cooling fan may be used together with the light emitting diode.

The shield unit 200 may be positioned at a front side of the light source unit 100, and may block a part of the light irradiated from the light source unit 100 so as to form a light irradiation pattern. Here, a distance between the light source unit 100 and the shield unit 200 may vary in accordance with a light irradiation range, a light irradiation pattern, or the like.

The shield unit 200 may have an opening portion 200*a* having a predetermined size and formed in a direction in which the light irradiated from the light source unit 100 proceeds, and may include at least one light blocking portion 210 which is formed at least one side of an upper side and a lower side based on an optical axis A of the light source unit 100, and has an outer circumferential end that is formed toward the optical axis A so as to block a part of the light irradiated from the light source unit 100. That is, the light blocking portion(s) 210 blocks a part of the light passing through the opening portion 200*a* so as to form the light irradiation pattern.

The light blocking portion(s) 210 may be formed to be extended from at least one side edge of an upper side and a lower side of the opening portion 200*a* toward the optical axis A so as to have an outer circumferential end, and may be formed so that the outer circumferential end covers a part of the light source 110. For example, as illustrated in FIG. 3, the light blocking portion(s) 210 may be formed at the lower side based on the optical axis A, and may be formed so that the outer circumferential end covers a part of the lower side of the light source 110. Here, FIG. 3 illustrates an example in which the lens unit 300 is omitted for explanatory convenience, but although not illustrated in FIG. 3, it should be understood that the lens unit 300 is present at the front side of the shield unit 200 as illustrated in FIGS. 1 and 2.

Accordingly, in comparison with a case in which a light blocking portion has a non-curved end, the outer circumferential end of the light blocking portion(s) 210 in the exemplary embodiment of the present invention blocks the light irradiated to the upper side based on a cut off line, so as to prevent light blindness of a driver in a preceding vehicle or an oncoming vehicle, and prevent the spectrum phenomenon and improve chromatic aberration.

Figure 4:
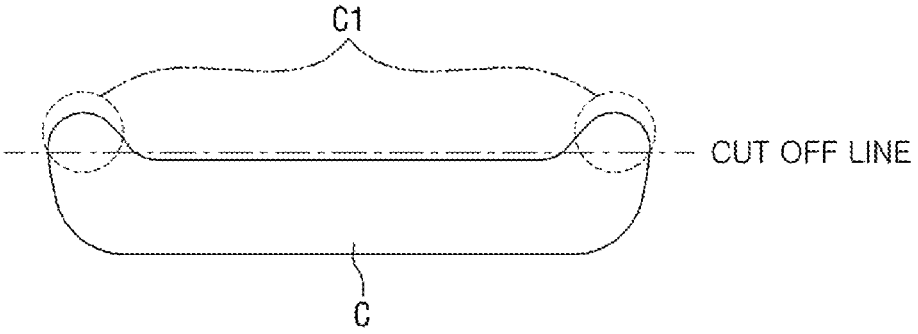
FIGS. 4 and 5 are schematic views illustrating a light irradiation pattern irradiated from the lamp for a vehicle according to the exemplary embodiment of the present invention.
Figure 5:
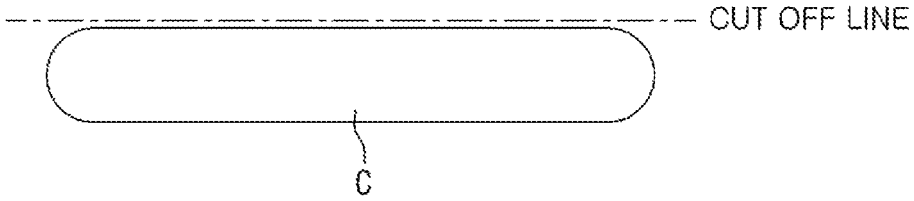

That is, according to the exemplary embodiment of the present invention, a portion C1, where the light is radiated to the upper side of the cut off line when the outer circumferential end of the light blocking portion(s) 210 has a horizontal shape as illustrated in FIG. 4, is removed from a light irradiation pattern C irradiated from the lamp 1 for a vehicle, and as illustrated in FIG. 5, the light irradiation pattern C, where the light is irradiated at a lower side based on the cut off line is formed, thereby preventing light blindness.

Figure 6:
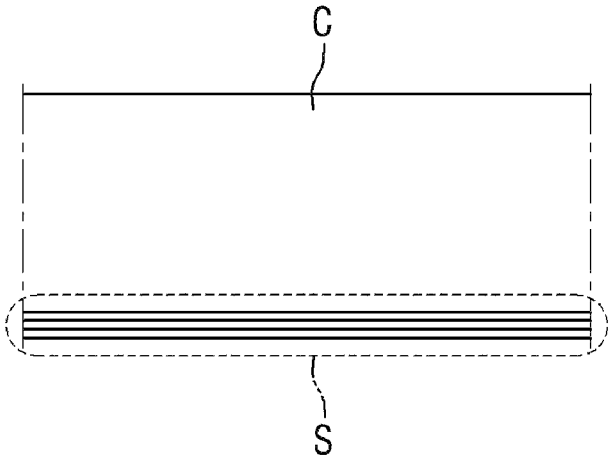
FIG. 6 is a schematic view illustrating a spectrum phenomenon occurring at the light irradiation pattern according to the exemplary embodiment of the present invention.

In addition, as illustrated in FIG. 6, the light blocking portion(s) 210 may serve to remove the spectrum phenomenon occurring at an upper side portion in the light irradiation pattern C irradiated from the lamp 1 for a vehicle. Here, in FIG. 6, an example is described in which the spectrum phenomenon occurs only at a lower side portion S in the light irradiation pattern C irradiated from the lamp 1 for a vehicle, but this example is merely for better understanding of the present invention, and the spectrum phenomenon occurring at the lower side portion S in the light irradiation pattern C irradiated from the lamp 1 for a vehicle may also be removed in some cases. In FIG. 6, the portion S where the spectrum phenomenon occurs is displayed by a plurality of solid lines, but this is an example in which the respective solid line sections shows the spectrum phenomenon having different colors. In addition, FIG. 6 illustrates a part of the light irradiation pattern C of FIG. 5, and the spectrum phenomenon of FIG. 6 may occur at the entire of the lower side portion of the light irradiation pattern C of FIG. 5.

Figure 7:
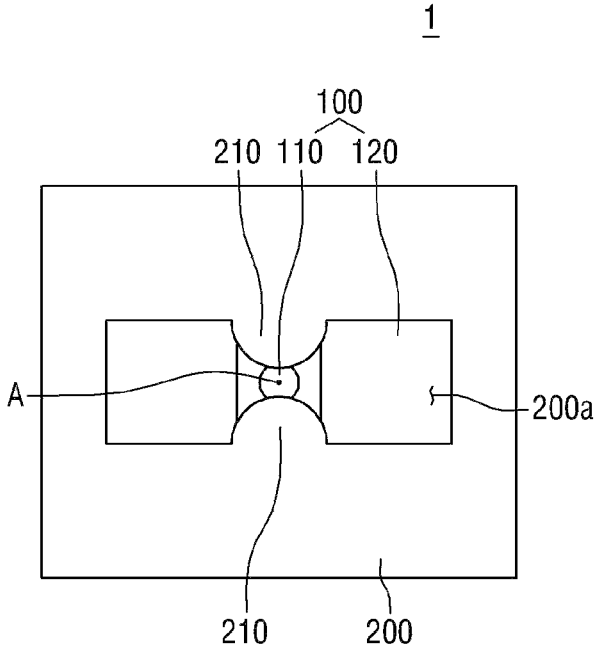
FIG. 7 is a front side view illustrating the lamp for a vehicle in which light blocking portions of FIG. 3 are formed at an upper side and a lower side of a light source unit.

Meanwhile, as described above, in order to remove the spectrum phenomenon occurring at the lower side portion S in the light irradiation pattern C irradiated from the lamp 1 for a vehicle, as illustrated in FIG. 7, but unlike FIGS. 1 to 3, the light blocking portions 210 may be formed at both the upper side and the lower side based on the optical axis A.

Figure 8:
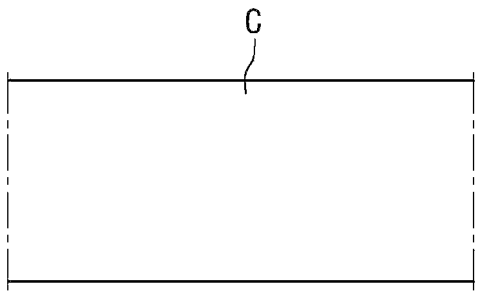
FIG. 8 is a schematic view illustrating a light irradiation pattern irradiated from the lamp for a vehicle of FIG. 7.

Therefore, when the light blocking portions 210 are formed at both the upper side and the lower side based on the optical axis A of the light source unit 100, as illustrated in FIG. 8, the spectrum phenomenon may be removed at both the upper side portion and the lower side portion in the light irradiation pattern C irradiated from the lamp 1 for a vehicle.

In other words, in the exemplary embodiment of the present invention, the light blocking portion(s) 210 is formed at least one of the upper side and the lower side based on the optical axis A of the light source unit 100 so as to form the suitable light irradiation pattern that satisfies the regulation, and remove the spectrum phenomenon and improve chromatic aberration, thereby securing a sufficient visual field.

The lens unit 300 irradiates the light, of which a part is blocked by the shield unit 200 among the light irradiated from the light source unit 100, toward the outside, and in the exemplary embodiment of the present invention, an example will be described in which an aspherical lens, which may adjust an irradiation range of the light by changing a curvature, is used. Here, in the exemplary embodiment of the present invention, an example in which an aspherical lens is used as the lens unit 300 is described, and the spectrum phenomenon, which occurs in accordance with a curvature or a material of the aspherical lens, may be removed by the aforementioned light blocking portion(s) 210.

The constituent elements 100, 200, and 300, which configure the aforementioned lamp 1 for a vehicle, may be coupled to each other by separate fastening members such as a bolt or by a hook coupling, and at least two constituent elements may be integrally formed together.

In addition, an example is described in which the lamp 1 for a vehicle according to the exemplary embodiment of the present invention includes the single light source unit 100, the shield unit 200, and the lens unit 300, but the present invention is not limited thereto, and in accordance with a shape or a size of the lamp 1 for a vehicle, the light source unit 100, the shield unit 200, and the lens unit 300 may be configured in a plurality and arranged in one direction.

Figure 9:
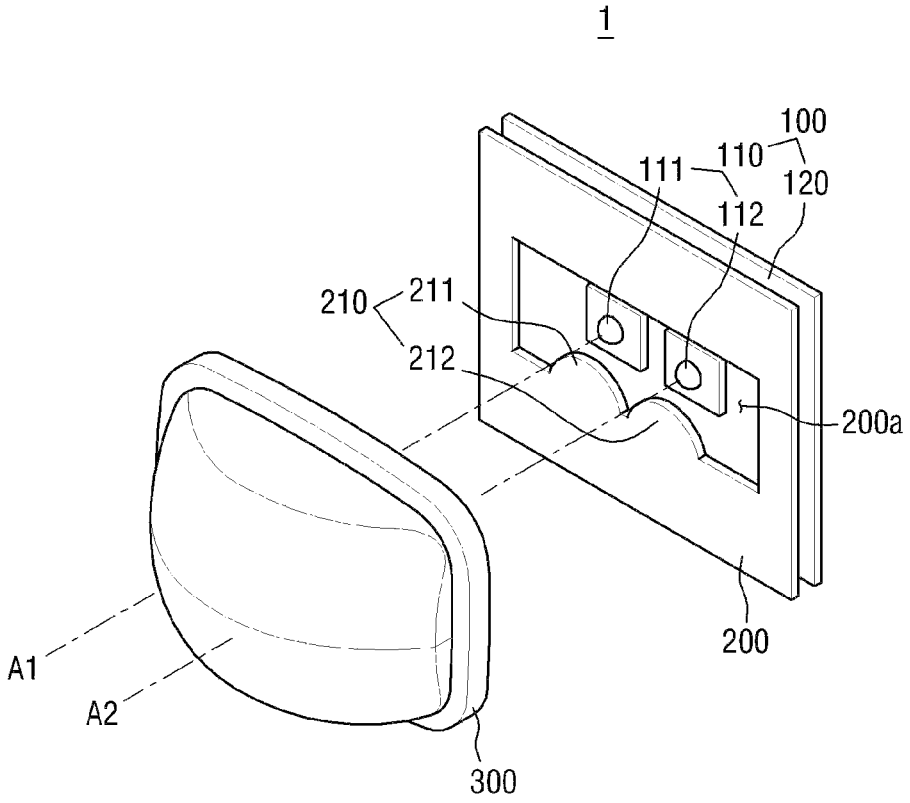
FIG. 9 is a perspective view illustrating a lamp for a vehicle according to another exemplary embodiment of the present invention.
Figure 10:
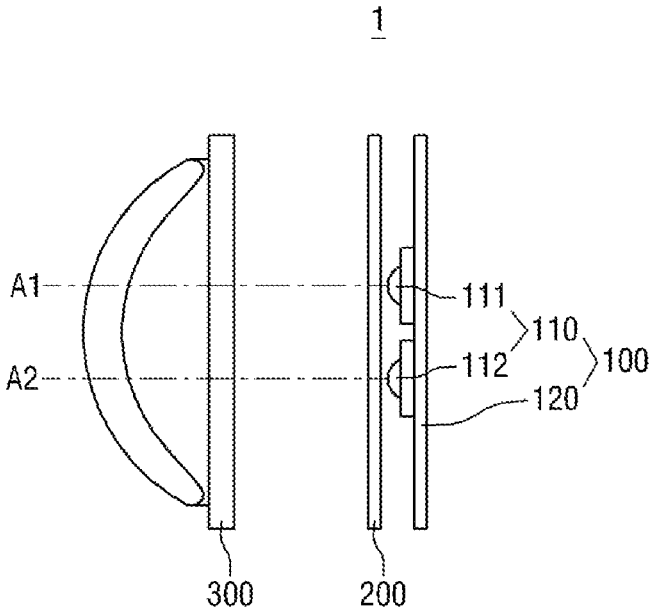
FIG. 10 is a plan view illustrating the lamp for a vehicle according to another exemplary embodiment of the present invention.
Figure 11:
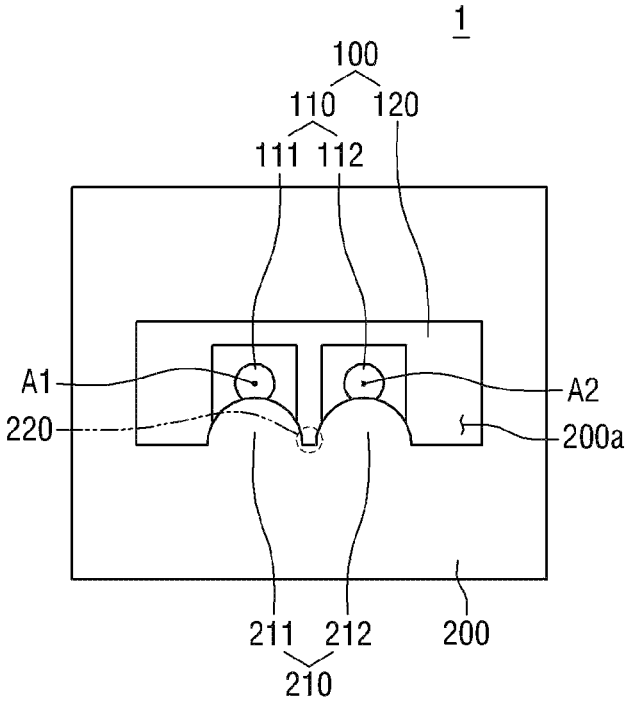
FIG. 11 is a front side view illustrating the lamp for a vehicle according to another exemplary embodiment of the present invention.

FIG. 9 is a perspective view illustrating a lamp for a vehicle according to another embodiment of the present invention, FIG. 10 is a plan view illustrating the lamp for a vehicle according to another embodiment of the present invention, and FIG. 11 is a front side view illustrating the lamp for a vehicle according to another embodiment of the present invention.

As illustrated, in the lamp 1 for a vehicle according to another embodiment of the present invention, the light source 110 of the light source unit 100 may be configured in a plurality like a first light source 111 and a second light source 112, the light blocking portion 210 of the shield unit 200 may be configured in a plurality like a first light blocking portion 211 and a second light blocking portion 212, and the first light blocking portion 211 and the second light blocking portion 212 may be formed to be extended toward optical axes A1 and A2 of the first light source 111 and the second light source 112 from one side edge of the opening portion 200*a* formed in the shield unit 200.

Here, because the lens unit 300 according to another exemplary embodiment of the present invention performs the same function as the aforementioned lens unit 300 of FIGS. 1 to 3, a detailed description thereof will be omitted, and although the lens unit 300 is omitted in FIG. 11 for explanatory convenience, it should be understood that the lens unit 300 is present at the front side of the shield unit 200 as illustrated in FIGS. 9 and 10.

The first light blocking portion 211 and the second light blocking portion 212 may be formed at least one side of the upper side and the lower side based on the optical axes of the first light source 111 and the second light source 112, respectively, and FIGS. 9 to 11 illustrate an example in which the first light blocking portion 211 and the second light blocking portion 212 are formed at the lower side based on the optical axes A1 and A2 of the first light source 111 and the second light source 112, respectively.

Here, a spacing portion 220, which allows the first light blocking portion 211 and the second light blocking portion 212 to be spaced apart from each other at a predetermined interval, may be formed between the first light blocking portion 211 and the second light blocking portion 212. The spacing portion 220 may form a hot spot, that is, a high luminance region, when the light is irradiated from the lamp 1 for a vehicle.

Figure 12:
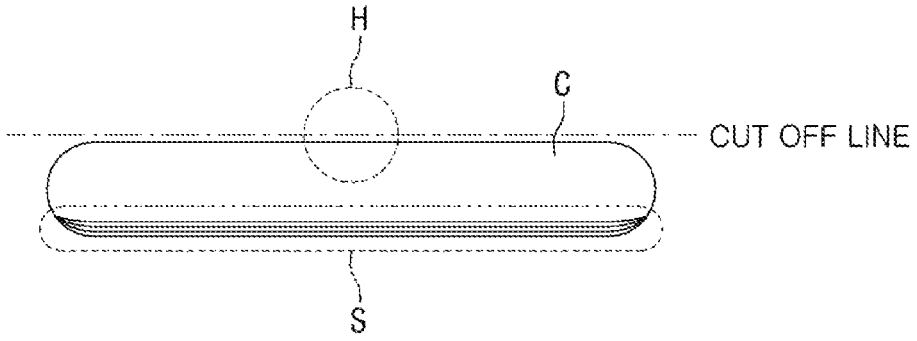
FIG. 12 is a schematic view illustrating a light irradiation pattern irradiated from the lamp for a vehicle according to another embodiment of the present invention.

Referring to the light irradiation pattern C irradiated from the lamp 1 for a vehicle according to another exemplary embodiment of the present invention, as illustrated in FIG. 12, the first light blocking portion 211 and the second light blocking portion 212 have a circumferential end toward the optical axes A1 and A2 of the first light source 111 and the second light source 112, respectively, such that the light, which is irradiated to the upper side based on the cut off line, is removed like FIG. 5, and the spectrum phenomenon may occur only at the lower side portion S in the light irradiation pattern C. In addition, a high luminance region H may be formed by the spacing portion 220 at a central portion of the light irradiation pattern C, and because of the high luminance region, the driver may secure a better front visual field.

Figure 13:
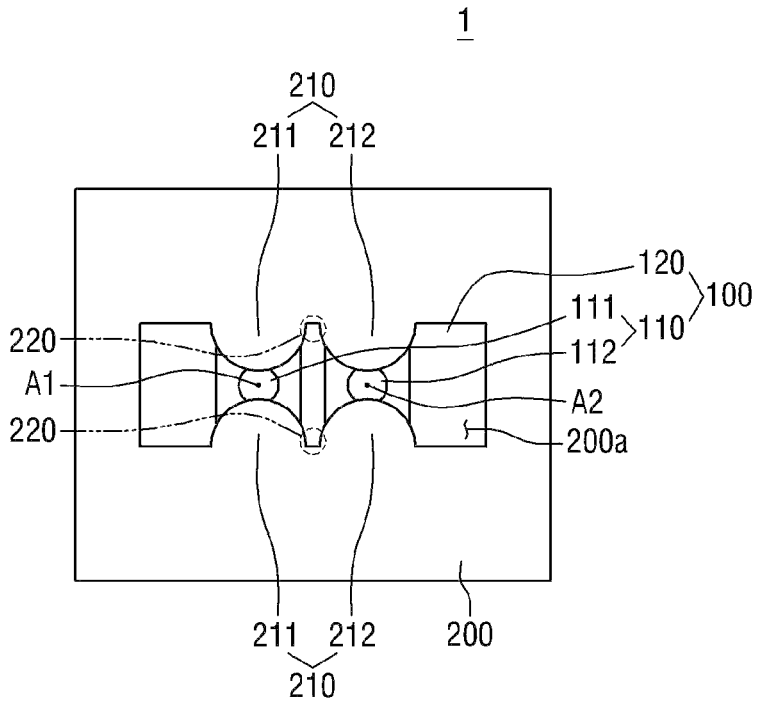
FIG. 13 is a front side view illustrating the lamp for a vehicle in which light blocking portions of FIG. 11 are formed at an upper side and a lower side of a light source unit.
Figure 14:
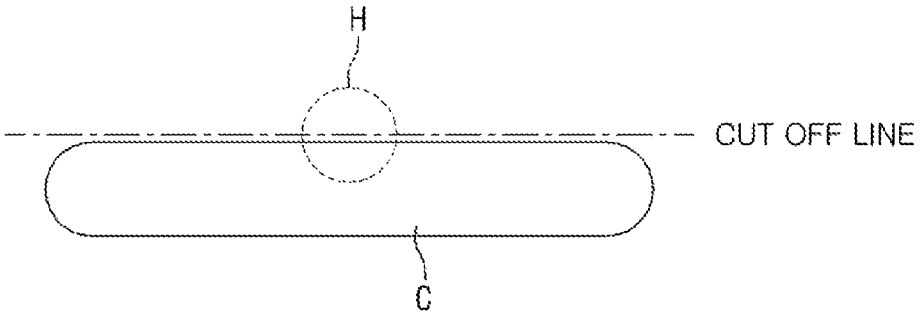
FIG. 14 is a schematic view illustrating a light irradiation pattern irradiated from the lamp for a vehicle of FIG. 13.

In addition, in another exemplary embodiment of the present invention, which is described above, an example is described in which the first light blocking portion 211 and the second light blocking portion 212 are formed on the lower side based on the optical axes A1 and A2 of the first light source 111 and the second light source 112, respectively, but the present invention is not limited thereto, and as illustrated in FIG. 13, the first light blocking portion 211 and the second light blocking portion 212 may be formed at both the upper side and the lower side based on the optical axes A1 and A2 of the first light source 111 and the second light source 112, respectively. In this case, as illustrated in FIG. 14, the spectrum phenomenon is removed at both the upper side portion and the lower side portion in the light irradiation pattern C irradiated from the lamp 1 for a vehicle, and the high luminance region H may be formed by the spacing portion 220.

Therefore, in another embodiment of the present invention, the first light blocking portion 211 and the second light blocking portion 212 are formed at least one side of the upper side and the lower side based on the optical axes A1 and A2 of the first light source 111 and the second light source 112, respectively, so as to form the suitable light irradiation pattern that satisfies the regulation and remove the spectrum phenomenon, thereby securing a sufficient visual field by improving chromatic aberration.

Meanwhile, in the exemplary embodiment of the present invention, as described above, an example is described in which the light blocking portion 210 is formed at least one of the upper side and the lower side of the shield unit 200 based on the optical axis of the light source unit 100, but the present invention is not limited thereto, and the shield unit 200 may be formed in a plurality, and one light blocking portion 210 is formed at the lower side, the other light blocking portion 210 is formed at the upper side, and then one light blocking portion 210 and the other light blocking portion 210 may be coupled to each other.

The foregoing is illustrative of the present invention and is not to be construed as limiting thereof. Although a few embodiments of the present invention have been described, those skilled in the art will readily appreciate that many modifications are possible in the embodiments without materially departing from the novel teachings and advantages of the present invention. Accordingly, all such modifications are intended to be included within the scope of the present invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The present invention is defined by the following claims, with equivalents of the claims to be included therein.

What is claimed is:

1. A lamp for a vehicle, comprising:

a light source unit including at least one light source;

a shield unit configured to block a part of light irradiated from the light source unit by one or more light blocking portions formed to have an outer circumferential end toward an optical axis of the light source unit; and a lens unit configured to irradiate light passing through the shield unit to the outside, wherein the one or more light blocking portions are formed to be extended toward the optical axis from one side edge of an opening portion formed in the shield unit in a direction in which the light irradiated from the light source unit proceeds.

2. The lamp of claim 1, wherein the one or more light blocking portions have the outer circumferential end that is formed to cover a part of the light source.

3. The lamp of claim 1, wherein the one or more light blocking portions are formed at least one side of an upper side and a lower side based on the optical axis of the light source unit.

4. The lamp of claim 1, wherein the one or more light blocking portions block the light irradiated to the upper side based on a cut off line.

5. The lamp of claim 1, wherein the one or more light blocking portions remove a spectrum phenomenon occurring at least one side of an upper side and a lower side of a light irradiation pattern.

6. The lamp of claim 1, wherein the light blocking portions are formed to be spaced apart from each other by a spacing portion at a predetermined interval in a direction in which the one or more light sources are arranged.

7. The lamp of claim 6, wherein the spacing portion forms a high luminance region in a light irradiation pattern.

8. A lamp for a vehicle, comprising:

a light source unit including at least one light source; and a shield unit configured to block a portion of light irradiated from the light source unit by one or more light blocking portions formed to have an outer circumferential end toward an optical axis of the light source unit, wherein the one or more light blocking portions are formed to be extended toward the optical axis from one side edge of an opening portion formed in the shield unit in a direction in which the light irradiated from the light source unit proceeds.

9. The lamp of claim 8, wherein the one or more light blocking portions have the outer circumferential end that is formed to cover a part of the light source.

10. The lamp of claim 8, wherein the one or more light blocking portions are formed at at least one side of an upper side and a lower side based on the optical axis of the light source unit.

11. The lamp of claim 8, wherein the one or more light blocking portions block the light irradiated to the upper side based on a cut off line.

12. The lamp of claim 8, wherein the one or more light blocking portions remove a spectrum phenomenon occurring at least one side of an upper side and a lower side of a light irradiation pattern.

13. The lamp of claim 8, wherein the light blocking portions are formed to be spaced apart from each other by a spacing portion at a predetermined interval in a direction in which the one or more light sources are arranged.

14. The lamp of claim 13, wherein the spacing portion forms a high luminance region in a light irradiation pattern.

15. The lamp of claim 8, further comprising a lens unit configured to irradiate light passing through the shield unit to the outside.

16. A lamp for a vehicle, comprising:

a light source unit including at least one light source;

a shield unit configured to block a part of light irradiated from the light source unit by one or more light blocking portions formed to have an outer circumferential end toward an optical axis of the light source unit; and a lens unit configured to irradiate light passing through the shield unit to the outside, wherein the one or more light blocking portions remove a spectrum phenomenon occurring at least one side of an upper side and a lower side of a light irradiation pattern, and wherein the one or more light blocking portions are formed to be extended toward the optical axis from one side edge of an opening portion formed in the shield unit in a direction in which the light irradiated from the light source unit proceeds.

* * * * *